US006705792B2

(12) United States Patent
Smith

(10) Patent No.: US 6,705,792 B2
(45) Date of Patent: Mar. 16, 2004

(54) CLEANING ATTACHMENT FOR CONVERTING A CLEANING IMPLEMENT TO A MOP

(75) Inventor: James A. Smith, Chatham, MA (US)

(73) Assignee: Watch Hill Harbor Technologies, Chatham, MA (US)

( * ) Notice: Subject to any disclaimer, the term of this patent is extended or adjusted under 35 U.S.C. 154(b) by 0 days.

(21) Appl. No.: 10/180,409

(22) Filed: Jun. 25, 2002

(65) Prior Publication Data

US 2003/0235457 A1 Dec. 25, 2003

(51) Int. Cl.[7] ..... A47L 13/44; A47L 17/08; A47L 13/22; A46B 11/02; A46B 11/04

(52) U.S. Cl. ..... 401/283; 401/282; 401/138; 401/137; 15/247; 15/231; 15/244.3; 15/104.94

(58) Field of Search ..... 15/231, 244.3, 15/247, 257.05, 104.93, 104.94; 220/736; 401/268, 282, 276, 138, 137, 283

(56) References Cited

U.S. PATENT DOCUMENTS

| | | | | |
|---|---|---|---|---|
| 960,158 | A | | 5/1910 | Cummings et al. |
| 1,080,572 | A | | 12/1913 | McDonald |
| 1,138,305 | A | | 5/1915 | Miller |
| 1,476,396 | A | | 12/1923 | Dickson |
| 1,929,082 | A | | 10/1933 | Simon |
| 2,221,305 | A | | 11/1940 | Chase |
| 2,269,424 | A | | 1/1942 | Bernstein |
| 2,293,461 | A | | 8/1942 | Gougeon |
| 2,382,205 | A | | 8/1945 | Coats |
| 2,446,814 | A | | 8/1948 | Crofton |
| 2,655,680 | A | | 10/1953 | Geerin |
| 2,709,824 | A | | 6/1955 | Hall |
| 2,733,470 | A | | 2/1956 | Wilder |
| 2,756,449 | A | * | 7/1956 | Dewey ..... 401/285 |
| 2,816,313 | A | | 12/1957 | Beck et al. |
| 2,858,559 | A | | 11/1958 | Carlson |
| 2,963,731 | A | | 12/1960 | Hoots |
| 2,999,265 | A | | 9/1961 | Duane et al. |
| 3,221,356 | A | | 12/1965 | Schirmer |
| 3,229,464 | A | * | 1/1966 | O'Brien et al. ..... 60/743 |
| 3,339,220 | A | | 9/1967 | Barry |
| 3,380,504 | A | | 4/1968 | Green |
| 3,400,420 | A | | 9/1968 | Granville et al. |
| 3,462,790 | A | | 8/1969 | Lingle |
| 3,737,938 | A | | 6/1973 | Saltzstein |
| 3,896,518 | A | | 7/1975 | Von Post et al. |
| 3,913,164 | A | | 10/1975 | Semenchuk |
| 4,084,910 | A | * | 4/1978 | LaRosa ..... 401/133 |

(List continued on next page.)

FOREIGN PATENT DOCUMENTS

| | | |
|---|---|---|
| FR | 2575058 | 12/1985 |

*Primary Examiner*—Robert J. Warden, Sr.
*Assistant Examiner*—Laura C Cole
(74) *Attorney, Agent, or Firm*—Connolly Bove Lodge & Hutz LLP

(57) ABSTRACT

A cleaning attachment for converting a cleaning implement to a mop is in the form of a flexible cover having spaced walls for being disposed on opposite sides of the cleaning head of the implement. The walls are connected together at the bottom portion by a central support surface. Wings extend outwardly from each side of the support surface. A container having cleaning solution is mounted to the attachment between one of the walls and its wing. Cleaning solution may be dispensed from the container through slots in the bottom of the container and then through a sponge pad covering the slots so that the cleaning solution could flow onto a wipe detachably mounted to the bottom portion of the attachment. Alternatively, the container could be a compressible container which would be squeezed between the wing and the wall by lowering the implement toward the floor to thereby force cleaning solution from the container.

26 Claims, 3 Drawing Sheets

U.S. PATENT DOCUMENTS

| | | | | | |
|---|---|---|---|---|---|
| 4,430,013 | A | * | 2/1984 | Kaufman | 401/132 |
| 4,455,705 | A | | 6/1984 | Graham | |
| 4,823,427 | A | | 4/1989 | Gibbs et al. | |
| 4,852,210 | A | | 8/1989 | Krajicek | |
| 4,945,599 | A | | 8/1990 | Flynn | |
| 5,000,602 | A | * | 3/1991 | Kim | 401/152 |
| 5,012,544 | A | | 5/1991 | Verry | |
| 5,042,105 | A | | 8/1991 | Buck et al. | |
| 5,094,559 | A | * | 3/1992 | Rivera et al. | 401/132 |
| 5,138,738 | A | | 8/1992 | Nicholson | |
| 5,177,831 | A | | 1/1993 | Wirth | |
| 5,217,787 | A | | 6/1993 | Monahan | |
| 5,280,664 | A | | 1/1994 | Lin | |
| 5,419,015 | A | | 5/1995 | Garcia | |
| 5,525,397 | A | | 6/1996 | Shizuno et al. | |
| 5,709,006 | A | | 1/1998 | Carter, Jr. | |
| 5,953,784 | A | | 9/1999 | Suzuki et al. | |
| 5,964,005 | A | | 10/1999 | Williams et al. | |
| 6,058,548 | A | | 5/2000 | Footer et al. | |
| 6,105,193 | A | | 8/2000 | Williams et al. | |
| 6,380,151 | B1 | | 4/2002 | Masters et al. | |
| 6,579,023 | B2 | | 6/2003 | Kunkler et al. | |
| 2002/0083964 | A1 | | 7/2002 | McKay | |
| 2002/0152569 | A1 | | 10/2002 | Zorzo | |
| 2003/0035679 | A1 | | 2/2003 | Zorzo | |
| 2003/0044569 | A1 | | 3/2003 | Kacher et al. | |
| 2003/0049407 | A1 | | 3/2003 | Kacher et al. | |
| 2003/0095826 | A1 | | 5/2003 | Policicchio et al. | |
| 2003/0110584 | A1 | | 6/2003 | Clare et al. | |

* cited by examiner

CLEANING ATTACHMENT FOR CONVERTING A CLEANING IMPLEMENT TO A MOP

BACKGROUND OF THE INVENTION

U.S. application Ser. No. 09/917,069 filed Jul. 27, 2001, and U.S. application Ser. No. 10/007,528 filed Dec. 5, 2001, describe various forms of cleaning attachments which are particularly usable for attachment to a broom or other cleaning implement to convert the cleaning implement to a mop. It would be desirable if beneficial variations of those techniques could be made.

SUMMARY OF THE INVENTION

An object of this invention is to provide a cleaning attachment for converting a cleaning implement to a mop.

In accordance with one aspect of this invention the cleaning attachment fits over the cleaning head of the cleaning implement. The cleaning attachment is in the form of a flexible cover having a pair of walls spaced from each other for fitting on opposite sides of the cleaning head of the implement. The upper ends of the walls are connected to each other for mounting the cover over the cleaning head near the handle of the implement. The lower ends of the walls are connected to each other by a central support surface which has a wing extending outwardly from each side of the support surface. A wipe, would be detachably mounted to the wings and support surface. A receptacle is also mounted to one of the wings for holding a cleaning solution which can be dispensed onto the wipe. The dispensing of the cleaning solution may advantageously take place through dispensing slots in the wing. A sponge is located over the slots to control the dispensing.

In a variation of the first embodiment of the invention a cleaning solution container or receptacle is detachably mounted to the cover in such a manner that the cleaning solution could be dispensed from the container. For examples the dispensing could be actuated by placing a wing against the floor or other surface being cleaned and then pivoting the handle toward that surface so as to squeeze the flexible container between the wing and its side wall of the attachment. The cleaning Solution could be expelled forwardly of the wing and wipe.

In a further variation of the invention, which need not include the cleaning solution container the cover is made with the wings and support surface in the form of a continuous curved surface. This can be accomplished by providing foam pads against the wings and support surface to give the desired curved shape. An outer skin may be disposed on the outer surface of the pads In accordance with still yet another variation of the invention the cover is made in a clam shell type construction wherein the walls are permanently secured together at the top portion. The bottom portion of the cover is divided into separated parts to permit the cover to be mounted over the broom or other implement and then have the lower parts connected together.

THE DRAWINGS

DETAILED DESCRIPTION

The present invention is based upon techniques shown and described in application Ser. No. 09/917,069 filed Jul. 27, 2001, and application Ser. No. 10/007,526 filed Dec. 5, 2001. All of the details of both of the applications are incorporated herein by reference thereto. Each of those applications relates to a cleaning attachment which would be mounted on the cleaning head of a cleaning implement, such as a broom having an elongated handle and a cleaning head to convert the implement to a mop. In general, the cleaning attachment has walls which would be mounted on each side of the cleaning head in such a manner that the walls are connected together on each side of the handle at the top portion of the attachment. The bottom portion of the attachment has a support surface between the spaced walls with a wing extending outwardly on each side of the central support surface. A wipe is detachably mounted to the exposed surface of the wings and central support surface.

The present invention includes variations of the above techniques whereby the cleaning implement can perform mopping functions. The implement itself could even be a mop which would be modified by the cleaning attachment to enhance the mopping functions. The following description would be directed in general to the variations of those descriptions in the two applications, it being understood that features described in those applications can be incorporated in the practices of the inventions herein.

FIGS. 1–5 are directed to a practice of the invention wherein a cleaning solution container is mounted to the cleaning attachment to permit a cleaning solution to be dispensed through the attachment and onto the wipe. Preferably, the cleaning solution container is permanently secured to or integrally part of the cleaning attachment itself.

Figure 1:
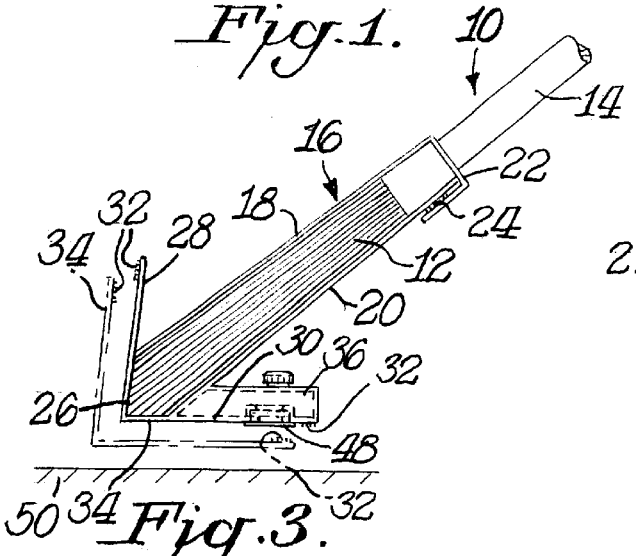
FIG. 1 is an exploded side elevational view showing the cleaning attachment of this invention mounted to a cleaning implement.
Figure 2:
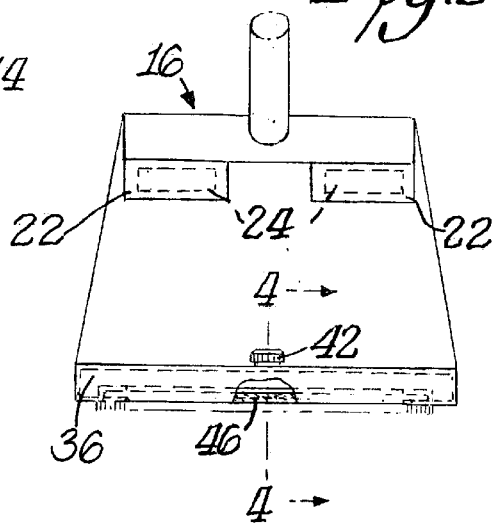
FIG. 2 is a front elevational view of the cleaning attachment shown in FIG. 1.
Figure 3:
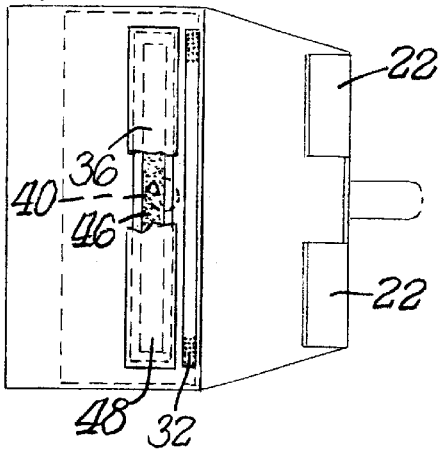
FIG. 3 is a bottom plan view of the cleaning attachment shown in FIGS. 1–2.

As shown in FIG. 1 a cleaning implement 10, such as a broom, includes a cleaning head 12 and an elongated handle 14 as described in the aforenoted applications. A cleaning attachment 16 is detachably mounted to head 12. Cleaning attachment 16 is in the form of a flexible cover having a pair of walls 18, 20 spaced from each other for fitting on opposite sides of the cleaning head 12. Each of the walls has an upper end with connecting structure such as flaps 22 extending from one wall such as wall 18 over the cleaning head 12 on each side:of handle 14 with complementary connecting structure 24 such as Velcro or hook and loop formations on the flaps 22 and wall 20 engaging each other to detachably mount the cleaning attachment 16 to the implement 10. The cleaning attachment 16 also includes a generally centrally located support surface or portion 26 in the spacing between the walls 18,20 at the bottom portion of cleaning attachment 16. A wing 28,30 extends outwardly on each side of the support surface 26 at a respective one of the walls 18,20. Reusable mounting structure 32, such as hook and loop formations or Velcro on the outer surface of wings 28,32 are located so as to engage complementary structure 32 on the inner surface of a detachable wipe 34 in the manner described in the aforenoted applications.

In accordance with the embodiment of the invention shown in FIGS. 1–5 a cleaning solution container 36 is incorporated in the cleaning attachment 16. In the illustrated form of this invention the cleaning solution container 36 is integral with wing 30 whereby wing 30 functions as the bottom wall for container 36.

Figure 4:
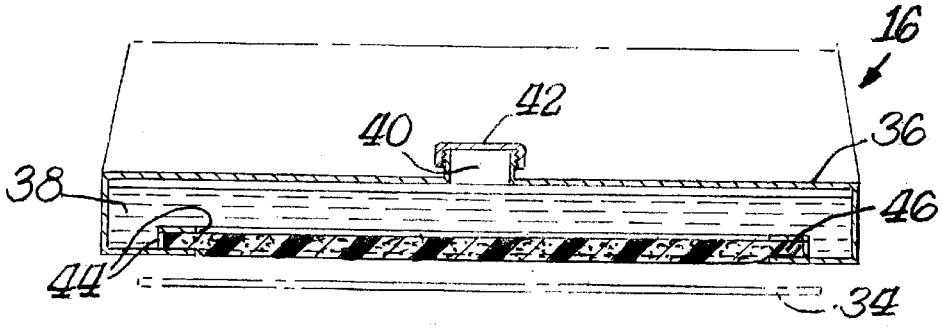
FIG. 4 is a cross-sectional view taken through FIG. 2 along the line 4—4.

As best shown in FIG. 4 container 36 is a reservoir for cleaning solution 38. The container can be filled through opening 40 selectively covered by cap 42. At least one and preferably a plurality of slots 44 are provided in a lower portion of container 36 in communication with a chamber in which a sponge member or pad 46 is mounted. The sponge member 46 functions to control the dispensing of the solution 38 from container 36 so that the solution 38 could then flow into contact with wipe 34 shown for the sake of clarity spaced from container 36. This differs from commercially available cleaning mops which are fitted with a trigger/hose that squirts out detergent solution on demand from a refillable dispenser. Such commercial mops are quite expensive selling in the range of, for example, $20.00–$25.00. The present invention, however, could incorporate the refillable tank or container 36 to dispense cleaning solution at a much lower cost.

Prior to use the outer surface of wing 30 in the area of sponge 46 would be covered with a suitable detachable cover 48 such as a strip of tape or the like. See FIGS. 1 and 3. Tape 48 would be removed immediately before wipe 34 is mounted to cleaning attachment 16.

Figure 5:
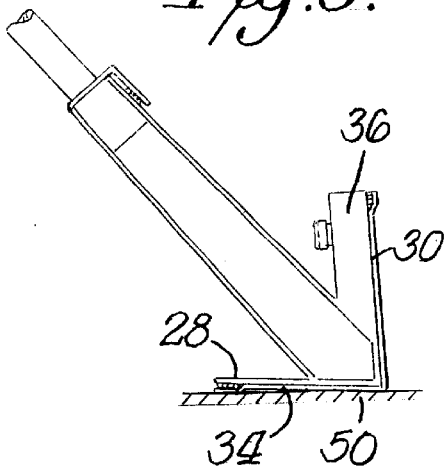
FIG. 5 is a side elevational view showing the cleaning attachment of FIGS. 1–4 in use.

In use, the flexible cleaning attachment 16 would thus clamp around, for example, an angle broom 10. When the wing 30 is disposed against the floor, wall or other structure 50 being cleaned, such as generally shown in FIG. 1, the cleaning solution would flow through slots 44 into sponge 46 and then against wipe 34. In this manner the implement 10 would function as a wet mop to wet the floor surface 50. By rotating the implement 10 to dispose the wing 28 toward the floor 50, as shown in FIG. 5, the implement 10 functions as a dry mop.

In the illustrated embodiment wing 30 itself is part of the tank or container 36. If desired, however, the tank or container 36 could be separate from and possibly even detachably mounted to wing 30. In such practice of the invention, wing would have either a plurality of slots or a single elongated slot disposed toward sponge 46 to permit the detergent or cleaning solution 38 to flow from the tank 36 and be absorbed in the double sided cloth or wipe 34. Where tank or container 36 is detachably mounted any suitable mounting means could be used such as adhesive or Velcro or loop and hook formations on the bottom of container 36 and the corresponding surface of wing 30.

Sponge 46 is preferably a reticulated polyether polyurethane foam sealed to the inside of the bottom of the detergent solution tank 36. Sponge 46 functions to cover the slots 44.

As previously indicated tank 36 includes a cap 42. The cap and closure could be secured to tank 36 as a fitmant heat sealed into the plastic film tank 36, thus providing a manner of filling and refilling the detergent or cleaning solution 38 such as a floor cleaning solution.

Figure 7:
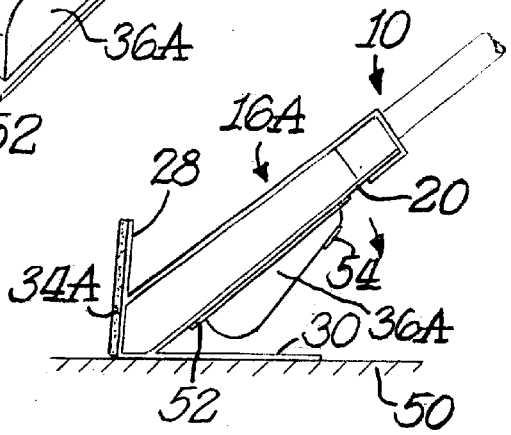
FIGS. 7–9 are side elevational views of a cleaning implement and attachment incorporating the container of FIG. 6 in different stages of use in accordance,with this further embodiment of this invention.

FIGS. 6–9 illustrate a variation of the invention wherein a tank 36A is detachably mounted to the cleaning attachment 16A. Any suitable detachable mounting structure could be used. For example, tanks 36A could include a mounting layer 52 which would be secured to wall 20 of cleaning attachment 16A as shown in FIG. 7. Wall 52 could be provided with an adhesive or stick tape surface as its attaching structure. Other forms of attachment, such as Velcro or clips, clamps, hooks, etc. could also be used.

Figure 8:
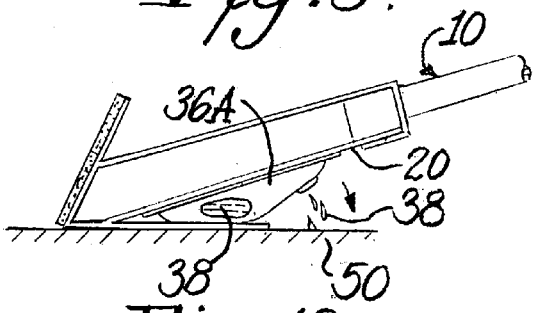
Figure 9:
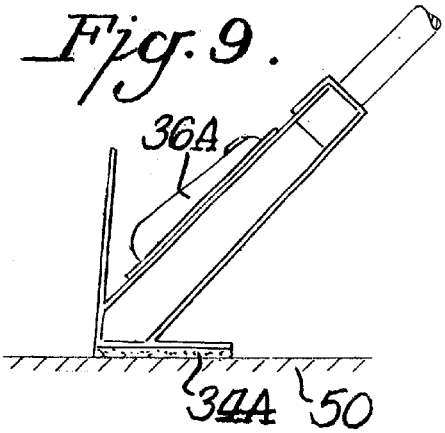

Tank 36A could be a thermoformed reservoir which contains the floor cleaning or other cleaning solution. Tank 36A could include a pressure responsive dispensing valve 54 so that upon applying a squeezing pressure to tank 36A the solution would squirt outwardly from the valve 54. FIG. 7 shows the position of implement 10 immediately before dispensing the solution. As shown therein, the wing 30 is disposed against floor 52. As shown in FIG. 8 implement 10 would then be pivoted downwardly to squeeze tank 36A between wing 30 and wall 2.0 thereby forcing drops of solution 38 out of tank 36A. The dispensing spout or valve 54 is located forwardly of the outer edge of wing 30 so that the solution 38 is squirted directly on the floor 50. Attachment 16A could contain a wipe as previously described which would be locate against both wings 28,30 so that the wipe would function in the manner previously described. Alternatively, the wipe 34A could be located against only one of the wings such as wing 28 or the wipe 34A could be thicker in its portion which is disposed against one of the wings. Thus, FIG. 9 illustrates the attachment being used when the implement 10 is in the reverse position from that shown in FIGS. 7 and 8. Thus, in FIG. 9 the wipe 34A is used to clean the floor. After a section of the floor is cleaned implement 10 would be reversed to squirt additional solution 38 on a new section of floor.

When all of the solution 38 has been dispensed from tank 36A the tank may be removed and discarded and then replaced by a new tank or pouch 36A.

The invention may also be practiced where the disposable tank 36A has dispensing slots similar to that of tank 36. The slots would be closed by a dispensing valve so that upon squeezing the tank between wing 30 and wall 20 the liquid or solution is caused to flow through the slots and through suitable openings in wing 30 onto the wipe attached to wipe 30. If desired a sponge similar to sponge 46 may be incorporated in this practice of the invention.

As should be apparent the tank 36A could be mounted to either the wall 20 or the wing 30 within the practice of the invention. Where an elongated tank 36A is intended to squirt the solution 38 forwardly of wing 30 it is preferred that the tank 36A be mounted to wall 20. If, however, the dispensing opening is located at a slot or opening in wing 30 the tank could be mounted to wing 30 itself. What is in common is that these variations employ the principles of FIGS. 6–9 where the dispensing is activated by squeezing the tank between two surfaces such as wing 30 and wall 20.

Figure 10:
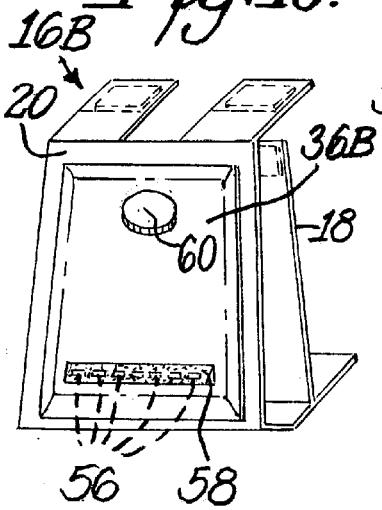
FIG. 10 is a perspective view showing yet another embodiment of this invention which incorporates a cleaning solution container.

FIG. 10 shows yet another embodiment of the invention. As shown therein container or tank 36B is mounted to wall 20 in any suitable manner such as previously described. In this practice of the invention attachment 16B does not include a wing which would correspond to wing 30. The solution would flow from tank 36B through slots 56 disposed in communication with foam layer 58 which functions as a spreader for the solution. Tank 36B could include a fill cap 60 which would permit new solution to be added where tank 36B is reusable. Thus tank 36B could be permanently mounted to wall 20. Alternatively, tank 36B could be detachably mounted and could be of single or limited number of uses.

Instead of tank 36B, a compressible tank similar to tank 36A could be mounted to wall 20 and squeezed between wall 20 and the floor to dispense the cleaning solution.

Figure 11:
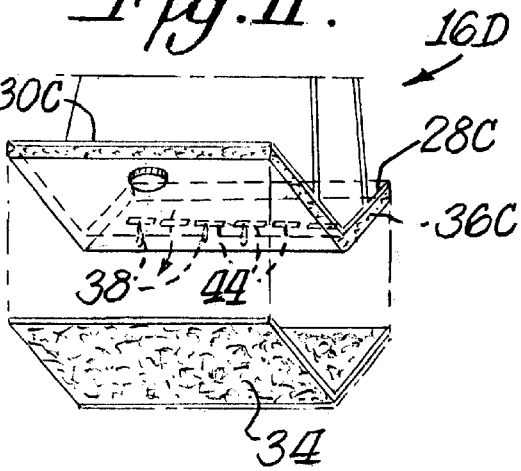
FIG. 11 is an exploded perspective view of still yet another embodiment of this invention incorporating a cleaning solution container.

FIG. 11 shows yet another embodiment of this invention wherein tank 36C is of a shape to extend against both wings 28C and 30C. Tank 36C could otherwise have similar structure to tank 36 wherein the solution would be dispensed only through wing 30C through slots 44 into contact with wipe 34.

Figure 12:
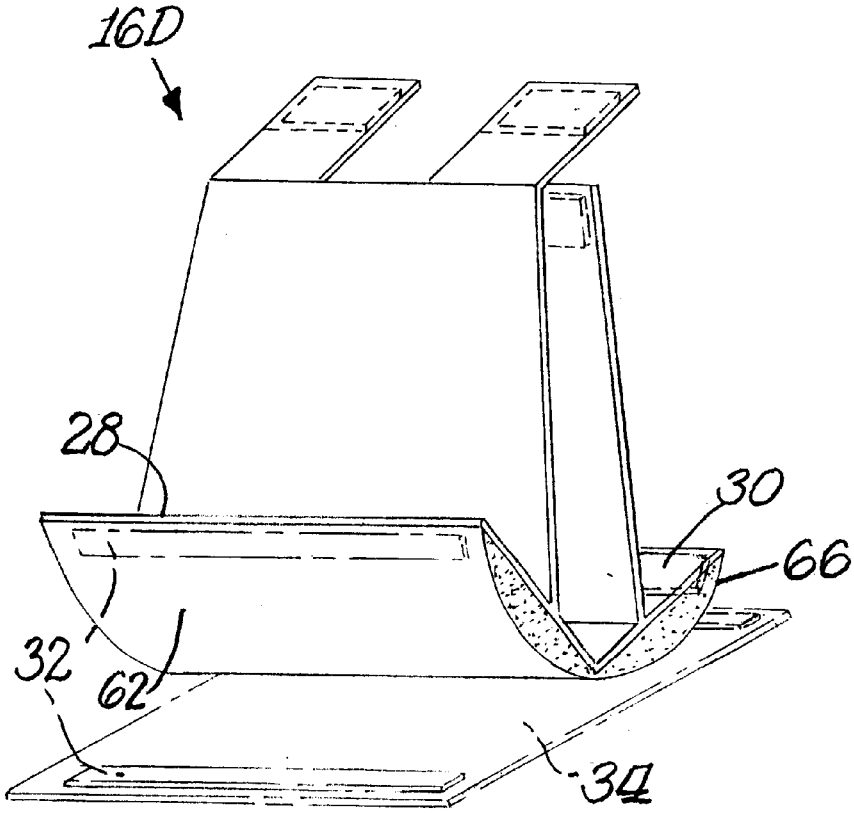
FIG. 12 is a perspective view of a modified form of attachment in accordance with yet another form of this invention.
Figure 13:
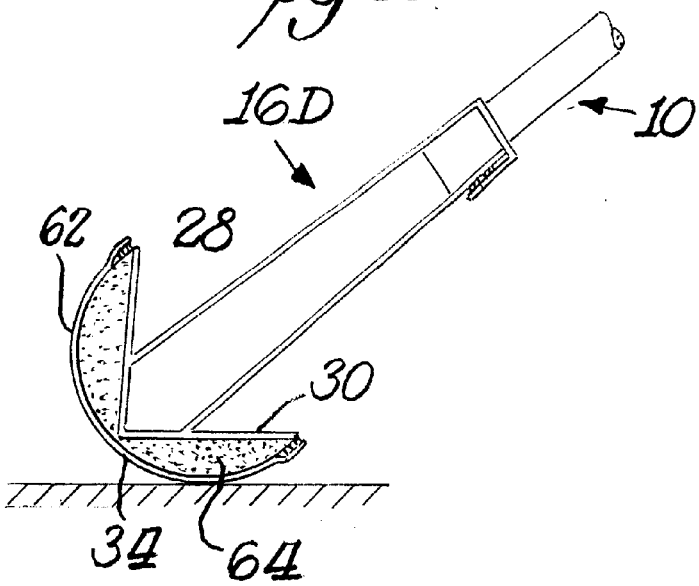
FIG. 13 is a side elevational view of the attachment shown in FIG. 12.

FIGS. 12–13 illustrate yet another practice of this invention which may, but need not, include a dispensing system such as a cleaning solution tank. As shown in FIGS. 12–13 the outer cleaning surface of attachment 16D has a curved surface 62 rather than a V-surface as in the other illustrated embodiments. The curved surface provides enhanced contact with the floor.

This would result in superior cleaning ability for both dry mopping for dust and dirt or wet cleaning. The curved surface enhances the benefit of having dual sided cleaning cloths. The curved surface 62 can be achieved in any suitable manner. As illustrated in FIGS. 12–13 a single continuous or two separate foam pads 64 are attached to wings 28,30 to give the desired outer surface. Fasteners 32 are provided on outer surface 62 to mate with complementary fasteners 32 on wipe 34.

While FIGS. 12–13 illustrate the curved surface 62 to be achieved by foam material, the curvature could also be achieved by padding the outer surfaces of wings 28,30 with other materials including non-woven, rubber or other padding that could be sealed in during the manufacturing step. Pressure could be applied to these soft curved surfaces by pressing on the broom 10 or other implement which would provide resiliency to the attachment head 16*d*. As illustrated the padded members 64 are covered by an outer layer or skin 66 of any suitable flexible material which could then be folded over and sewn or heat sealed to wings 28,30.

Figure 14:
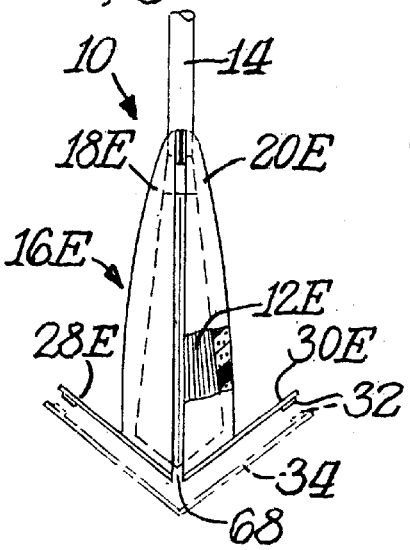
FIG. 14 is a side elevational view of still yet another form of attachment in accordance with this invention.
Figure 6:
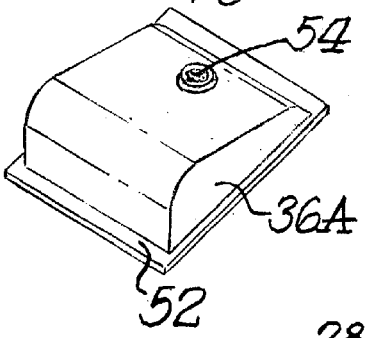
FIG. 6 is a perspective view of a cleaning solution container for use in a further embodiment of this invention.

FIG. 14 shows yet another embodiment of this invention. This embodiment involved the manner of forming and mounting attachment 16E. In the previously described embodiments the attachment is mounted to the cleaning head by flaps which extend from one wall over the top of the cleaning head against the other wall. The flaps include fastening structure which mate with complementary fastening structure. In those practices of the invention the bottom portion of the attachment is of one piece permanently connected structure. FIG. 14 illustrates a variation where the attachment is of a clam shell type having the upper ends of walls 18E and 20E integral with each other, but including a central spacing to permit the handle 14 of the implement 10 to be inserted through the spacing. The clam shell structure involves having the bottom portion of attachment 16E spaced from and movable away from each other instead of having an integral central support surface. In other words the central support surface is two sections separate from each other. Thus, FIG. 14 illustrates a gap 68 formed in the central support surface of attachment 16E so that the wings 28E, 30E can be moved away from each other to permit the attachment to be mounted over the cleaning head 12E. The attachment 16E could be made of a plastic thermoformed unit that clamps around the implement 10. The unit could then be maintained closed by any suitable structure such as by snap closures or Velcro hook and loop formations. Once closed the wipe 34 would be mounted to wings 28E and 30E. If desired, the fastening structure 32 on the wings and wipe could be used as a supplemental or as the sole manner of maintaining the clam shell attachment 16E in its closed condition.

It is to be understood that the invention could be practiced by incorporating features of one embodiment into other embodiments. Thus, for example, the embodiments of FIGS. 12–13 and 14 could include a cleaning solution container. Where appropriate the attachment could include only a single wing in Various embodiments.

What is claimed is:

1. A cleaning attachment for a cleaning implement having an elongated handle and a cleaning head attached to one end of the handle, said cleaning attachment comprising a flexible cover, said flexible cover including a pair of walls spaced from each other for fitting on opposite sides of the cleaning head, each of said walls having an upper end, connecting structure at said upper ends connecting said walls together, said connecting structure having a generally centrally located spacing whereby said connecting structure may be disposed above and over the cleaning head with the handle located in the spacing, each of said walls having a lower end, said lower ends being connected to each other by a central support surface, a wing extending outwardly on each side of said support surface extending outwardly at a respective one of each of said walls, said wings having an outer surface, reusable mounting structure on said outer surface to detachably mount a detached wipe to said outer surface below the cleaning head, a container mounted to one of said wings for holding a cleaning solution, and said container communicating with said outer surface of said one wing through dispensing slots whereby cleaning solution may flow from said container and through said one wing and into the wipe when the wipe is attached to said wings.

2. The attachment of claim 1 wherein said slots are located in the bottom of said container.

3. The attachment of claim 2 including sponge located across and outwardly of said slots.

4. The attachment of claim 3 including a detachable cover strip outwardly of said sponge to sea said slots closed before use of said attachment.

5. The attachment of claim 3 wherein said one wing is said bottom of said container.

6. The attachment of claim 3 wherein said container extends across both of said wings.

7. The attachment of claim 3 including a fill opening in said container, and a removable cap selectively mounted over said fill opening.

8. The attachment of claim 1 wherein said connecting structure includes flaps mounted to one of said walls detachably connected to the other of said walls.

9. The attachment of claim 1 wherein said attachment is of clam shell form with said connecting structure being integral with said walls, said central support surface being in two sections separate from each other, and said two sections being detachably secured together by securing structure.

10. The attachment of claim 9 wherein said securing structure spans the spacing between said sections.

11. The attachment of claim 1 wherein said outer surface of said wings and of said central support surface forms a smooth continuous curved surface.

12. The attachment of claim 1 in combination with the cleaning implement, said cleaning implement being a broom, and a wipe mounted to said wings.

13. The cleaning attachment for a cleaning implement having an elongated handle and a cleaning head attached to one end of the handle, said cleaning attachment comprising a flexible cover having a top portion and a bottom portion, said flexible cover including a pair of walls spaced from each other for fitting on opposite sides of the cleaning head, each of said walls having an upper end at said top portion, connecting structure at said upper ends connecting said walls together, said connecting structure having a generally centrally located spacing whereby said connecting structure may be disposed above and over the cleaning head with the handle located in the spacing, each of said walls having a lower end at said bottom portion, said lower ends being connected to each other by a central support surface, a wing extending outwardly from said support surface on at least one side of said support surface to be disposed toward one of said pair of walls, said wing and said one wall being pivotable toward each other, reusable mounting structure on the outer surface of said bottom portion to detachably mount a detached wipe to said outer surface below the cleaning head, a container for holding a cleaning solution mounted between said wing and said one wall, said container having at least one outlet opening directed away from said one wall, and said container being made of a compressible material whereby when said wing and said one wall are pivoted toward each other to squeeze said container the cleaning solution is forced out of said dispensing opening.

14. The attachment of claim 13 wherein said outlet opening contains a pressure responsive valve to control flow through said outlet opening.

15. The attachment of claim 13 wherein said container is mounted to said one wall.

16. The attachment of claim 15 wherein said container is detachably mounted to said one wall.

17. The attachment of claim 15 wherein said outlet opening is located forwardly of said wing.

18. The attachment of claim 17 wherein said wing is a first wing, including a second wing extending from said support surface in a direction opposite said first wing, and said wipe being mounted to said second wing.

19. The attachment of claim 18 wherein said wipe is also mounted to said first wing.

20. The attachment of claim 13 wherein said bottom portion has an outer surface which is a smooth continuous curve.

21. The attachment of claim 13 wherein said attachment is clam shell form with said connecting structure being integral with said walls, said central support surface being in two sections separate from each other, and said two sections being detachably secured together by securing structure.

22. The attachment of claim 13 in combination with the cleaning implement, said cleaning implement being a broom, and a wipe mounted to said bottom portion.

23. A cleaning attachment for a cleaning implement having an elongated handle and a cleaning head attached to one end of the handle, said cleaning attachment comprising a flexible cover having a top portion and a bottom portion, said flexible cover including a pair of walls spaced from each other for fitting on opposite sides of the cleaning head, each of said walls having an upper end at said top portion, connecting structure at said upper ends connecting said walls together, said connecting structure having a generally centrally located spacing whereby said connecting structure may be disposed above and over the cleaning head with the handle located in the spacing, each of said walls having a lower end at said bottom portion, said lower ends being connected to each other by a central support surface, said attachment including a container for holding a cleaning solution, said container having a bottom wall, a plurality of dispensing slots in said bottom wall, a sponge layer mounted across said slots, and reusable mounting structure on the outer surface of said bottom portion to detachably mount a detached wipe to said outer surface below the cleaning head, wherein said container is positioned on said attachment to be operable to dispense cleaning solution onto a surface to be cleaned.

24. The attachment of claim 23 wherein said container is mounted to one of said walls.

25. The attachment of claim 23 wherein a wing is mounted outwardly from each side of said central support surface, and said container being mounted to one of said wings.

26. The attachment of claim 23 in combination with said cleaning implement, said implement being a broom, and a wipe detachably mounted to said bottom portion.

* * * * *